United States Patent [19]

Gauck

[11] Patent Number: 4,519,235

[45] Date of Patent: May 28, 1985

[54] LOUVER TOOL

[76] Inventor: Donald A. Gauck, 24 Falcon La., Cincinnati, Ohio 45218

[21] Appl. No.: 541,465

[22] Filed: Oct. 13, 1983

[51] Int. Cl.[3] ..... B21D 17/02

[52] U.S. Cl. ..... 72/414; 72/379; 72/454; 72/475

[58] Field of Search ..... 72/379, 392, 412, 414, 72/454, 475; 29/160

[56] References Cited

U.S. PATENT DOCUMENTS 1,353,524 9/1920 Fleming et al. ..... 72/326
1,397,980 11/1921 Quellette .
2,646,706 7/1953 Palmer .
2,728,316 12/1955 Oberg ..... 72/379
3,943,744 3/1976 Marsh et al. ..... 72/326

*Primary Examiner*—Daniel C. Crane
*Assistant Examiner*—David B. Jones
*Attorney, Agent, or Firm*—Frost & Jacobs

[57] ABSTRACT

The present invention relates to a louver fabricating tool comprising a shaper element and a die element. The die element includes a recessed area having side walls and projections and an outwardly tapered apex wall. The shaper element includes an abutting region designed to fit a portion of the recessed area. The louver tool is portable and can form louvers in situ in sheet like material capable of being deformed because the louver tool only requires access to one side of the deformable sheet-like material in order to fabricate the louver.

15 Claims, 4 Drawing Figures

LOUVER TOOL

BACKGROUND OF THE INVENTION

1. Field of the Invention

The present invention pertains to a portable louver forming tool for fabricating louvers or vents in sheet metal or other shape-holding material such as plastic.

2. Background of the Invention

Typically, vents or louvers are employed for ventilation purposes in such articles as automobile hoods, ventilation ducts, or housings around furnaces, air conditioners or other equipment. The louvers permit air to circulate, for example, from inside a particular enclosure to the outside of the enclosure as exemplified by louvers in housings around air conditioners, or permit air to circulate from outside to the inside of an enclosure as exemplified by louvers formed in hoods of automobiles such that when the automobile is moving, air is forced through the louvers into the engine compartment to help prevent overheating of the engine.

Generally, louvers and vents are formed by first cutting the sheet metal with a cutting or shearing blade and pressing the sheet metal into a die mold which shapes and forms the louvers. Such a typical procedure necessitates transporting the sheet metal to the louver fabricating device because all prior art louver forming tools required access to both sides of the sheet metal in order to cut and form the louvers or vents. If louvers are desired in a sheet metal enclosure after original assembly, it becomes difficult to dismantle the enclosure and transport the sheet metal enclosure to a louver fabricating tool.

U.S. Pat. No. 1,353,524 issued to Fleming, et al shows a typical machine for cutting vents in automobile hoods. This machine is designed to be mounted upon a stationary horizontal surface and is not meant to be portable. The device comprises a swing arm 4 and a cutting and shaping element 5. Both the swing arm and the cutting and shaping element mechanically relate to the die opening 19 which molds the sheet metal into the form of a louver. The sheet metal is placed between the cutting and shaping element 5 and the die opening 19. By pulling downwardly on handle 13 the cutting element 5 slits the sheet metal and presses the edges of the slit into the die opening 19, thus fabricating a louver. Different size louvers can be fabricated depending upon the selected size of the cutting and shaping element 5 and the corresponding die opening 19.

U.S. Pat. No. 2,728,316 to Oberg et al is directed to a combination shearing and pressing tool to produce ventilation openings. The tool comprises a punch 4 with a circular cutting edge 12 and a corresponding die element 5 which shapes the louver. The sheet metal is placed between the punch 4 and the die element 5. Handle 18 is pulled downwardly by an operator forcing the punch to slit the sheet metal and force an edge of the sheet metal into the corresponding die element 5 which forms and shapes the louver. This device is not portable.

U.S. Pat. No. 3,943,744 issued to Marsh et al shows a louver cutter with a cutting blade 40 and a die pad 14. Once the sheet metal is positioned between the cutting blade 40 and the die pad 14, handle 30 can be pulled in a clock-wise fashion causing blade 40 to slits the sheet metal and deform the metal into the shape of a louver opening. This tool is not portable.

As is noted by the prior art references, none of the prior art tools are capable of forming louvers in sheet metal or the like with a portable tool such that the louvers can be formed in situ. Also, none of the prior art tools teach the capability of forming a louver in sheet metal by merely having access to one side of the sheet metal, that is, all prior art tools of necessity require access to both sides of the sheet metal in order to fabricate a louver.

SUMMARY OF THE INVENTION

The portable louver tool of the present invention essentially comprises two members, one member being a shaping element and the other member being a die element. As in the typical procedure, a slit is made in the sheet metal or other shape-forming material in which a louver is desired. The shaper is inserted into the slit until the slit incision is adjacent the spacing ledge with due care being excercised so as not to split or rip the incision. The die is then positioned adjacent the shaper and can be held in place by studs or other fastening means. As the die is being solidly fastened to the shaper, the shaper presses the sheet metal into the die forming a louver.

The chief characteristics of the present invention are constituted by the fact that the louver tool is completely portable and does not require an operator to have access to both sides of the enclosure in order to fully operate the present invention tool when fabricating the louver. Accordingly, in the example of fabricating a louver in the hood of an automobile, the hood need not be dismantled or removed from the automobile during fabrication. Consequently, the tool of the present invention is extremely useful in a machine shop. The louver fabricating tool can also be employed by heating and ventilation technicians who fabricate louvers in ventilation ducts, furnace or air conditioning enclosures.

In particular, the present invention comprises a louver fabricating tool comprising a shaper element and a die element, said die element including a recessed area, said recessed area having side walls and projection with an outwardly tapered apex; said shaper element including an abutting region designed to contact at least a portion of said recessed area and including a shaper segment sized to fit within the recessed area between the projection and apex.

The present invention also includes a process for fabricating louvers in-situ comprising: cutting an incision into a material capable of being deformed, inserting a shaping element into said incision and fastening a die element onto said shaper element, thereby forcing said shaping element to press the sheet metal into the die thus fabricating the louver.

Other features of the present invention will become more apparent with the complete disclosure set forth below.

DESCRIPTION OF THE PREFERRED EMBODIMENT

The louver fabricating tool of the present invention can be employed to fabricate louvers in any material capable of retaining the form into which it is molded, such as sheet metal, plastic or the like. For purposes of illustration only, the description will describe fabricating louvers in sheet metal without the intention of being limited to such.

Figure 1:
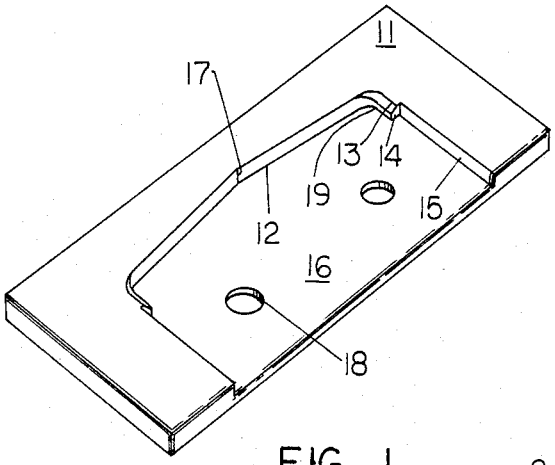
FIG. 1 is a perspective view of the die member of the louver fabricating tool.

The die element shown in FIG. 1 of the drawing is a flat rectangular metal plate with a recessed area 16. Contact surface 11 is the surface which contacts the metal to be fabricated into a louver. Also, the triangular area bound by projections 14 and apex 17 also contacts the metal but this area only contacts the raised portion of the louver.

Recessed area 16 is bound by side wall 15, projection 14, intermediate side wall 19 and apex wall 12. Intermediate side wall 19 has a circinate edge 13 designed to prevent the louver incision ends from splitting further. The circinate edges round the short side walls 25 of a louver, which walls are under high stress during the fabrication process. Accordingly, although the circinate edges are not necessary, they relieve some of the tension and stress placed upon the sheet metal along the short side 25.

Figure 2:
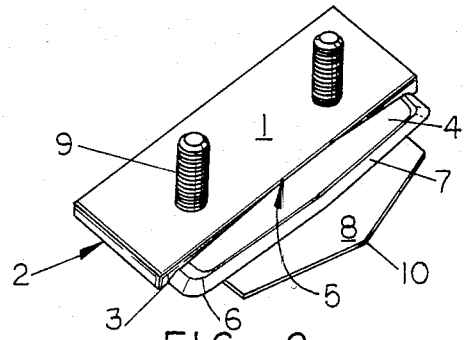
FIG. 2 is a perspective view of the shaper member of the tool.
Figure 3:
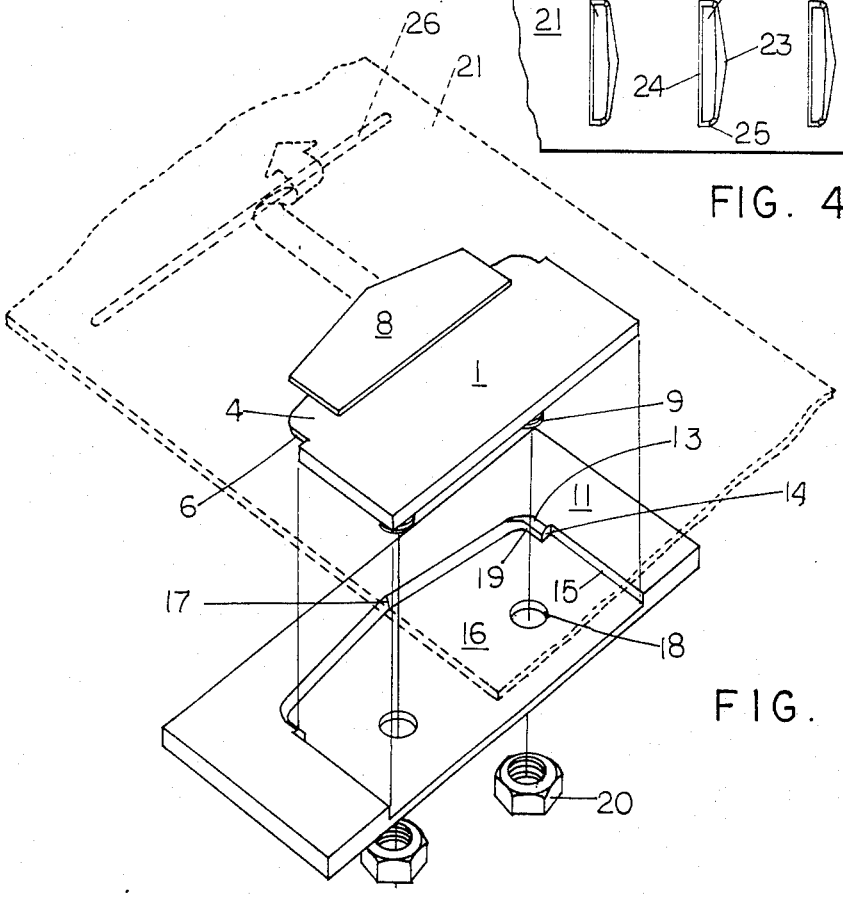
FIG. 3 is a perspective view illustrating how the louver fabricating tool of the present invention is designed to operate in conjunction with a piece of a sheet metal shown in phantom including a slit or incision.

Illustrated in FIG. 2 is the shaper element whose abutting region 1 is a flat rectangular region which abuts the die element during operation. Shaper segment 4 is integral with abutting region 1, as is illustrated in FIG. 3 showing the back side of the shaper element. Abutting region 1 smoothly blends into shaper segment 4 at the crown segment 5. At either end of shaper segment 4 is a recessed ledge 3 formed by virtue of shaper segment 4 being set back from side edge 2 and gradually tapered from abutting region 1. Shaper segment 4 includes circinate side edge 6 and circinate flap edge 7, thus producing a gradually taper from abutting region 1 to a smooth thin edge on its sides, and from abutting region 1 to tuck flap 8. Tuck flap 8 is a thin piece of metal firmly attached to the shaper element and designed to be sufficiently thin to permit insertion into the incision of the sheet metal. To assist in the insertion, tuck flap 8 is formed with a vertex 10. Because it is easier to insert a point into the incision as opposed to a complete edge, vertex 10 makes the insertion a simple task.

Because tuck flap 8 is shorter in length than shaper segment 4, it can easily be inserted into the incision paving the way for subsequent insertion of of shaper segment 4 into the incision. The circinate flap edge 7 and circinate side edge 6 present no sharp hard edges capable of obstructing or retarding insertion of the shaper segment into the incision until recess ledge 3 is adjacent one edge of the incision. Recess ledge 3 serves as a barrier to prevent further insertion of the shaper element into the incision which prevents side edge 2 from ripping or tearing the sheet metal.

Shaper segment 4 contacts the sheet metal and performs the function of forming the louver when the die is tightly fastened against the shaper element. Abutting region 1 is sized to fit within recessed area 16 up to projection 14. In other words, recessed ledge 3 and projection 14 are juxtaposed during fabrication. Likewise, side wall 15 and side edge 2 are juxtaposed. Fastening the shaper element to the die element can be done by any means well known to those skilled in the art such as, for example, stud bolts 9, openings 18 through which the stud bolts project and nuts 20 which when threaded tightly upon stud bolts 9 secure the die mold and shaper element integrally. However, other fastening means could also be employed, such as rachet clips, etc., known to those skilled in the art.

In operation, the present device is simple to use. A split or incision is first cut into the sheet metal where it is desired to locate the louver. The incision can be cut by any means such as a saw, cutting torch or more exotic means such as laser cutting. The edges of the incision are pried apart by inserting tuck flap 8 into the incision as is shown in phantom in FIG. 3. Tuck flap 8 paves the way for subsequent insertion of shaper segment 4. The tapered ends of the tuck flap 8 help automatically align the shaper element within the incision such that the louver will be perfectly centered when formed. Tuck flap 8 and shaper segment 4 are inserted into the incision until recessed ledge 3 abuts the incision. At this point, the backside of the abutting region will be contacting the sheet metal as much as the incision and shaper element will permit without the die member being fastened thereto.

The die element is then mounted upon the shaper element by aligning and sliding the stud bolts 9 through holes 18 of the die element with recessed portion 16 mating abutting region 1 of the shaper element. Vertex 10 of tuck flap 8 extends beyond apex 17 when the die element is tightly fastened to the shaper element. This prevents apex wall 12 from overstressing and ripping the sheet metal by forming the sheet metal to the contour of shaper segment 4, as opposed to the sharp edges of the apex wall 12. Also, tuck flap 8 helps maintain the sheet metal area above the louver top 23 in a flat shape as is illustrated in FIG. 4.

Once the nuts 20 have been tightened sufficiently to press form the sheet metal into the die element, thereby forming a louver, the nuts can be removed and the die member removed from the shaper element. The shaper element is then removed from the fabricated louver with care being exercised not to destroy the shape of the louver when extracting the tuck flap from the louver incision.

Figure 4:
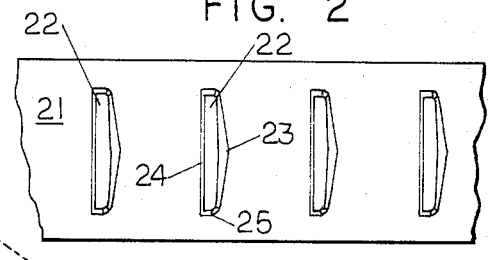
FIG. 4 is a planar view showing sheet metal with louvers formed therein.

FIG. 4 shows several louvers 22 which have been fabricated in sheet metal 21 forming a louver with a straight bottom incision edge 24, small louver sides 25 and a louver top 23.

Of course, different size louvers can be made by merely employing different size die and shaper elements and cutting the incision to sizes corresponding to the desired louver size. Because of the simplistic nature of the louver fabricating device, a machine shop or ventilation technician could easily afford to have in stock a complete series of sizes to accommodate all prospective customers. One typical size, for example, is made from steel sheet metal with the shaper element being approximately $\frac{1}{4}$ inch thick, approximately 2 inches wide and approximately 5 inches long. The corresponding die element is approximately $\frac{1}{2}$ inch thick by 3 inches wide and 7 inches long. The weight of the total louver fabricating tool of this size is approximately $\frac{3}{4}$ pounds.

What is claimed is:

1. A louver fabricating tool for forming louvers in a material wherein an operator only has access to one side of said material comprising:

(1) a shaper element; and (2) a die element, said die element including a recessed area, said recessed area having side walls and projections, and an outwardly tapered apex wall; said shaper element including an abutting region designed to contact at least a portion of said recessed area, and including a shaper segment having recessed ledges at each end thereof and sized to fit within the recessed area between the projections and apex said shaper element further including a tuck flap attached to said shaper segment for insertion into an incision in the work material.

2. The louver fabricating tool of claim 1, wherein said tuck flap is tapered and includes a vertex.

3. The louver fabricating tool of claim 1, wherein said shaper segment includes circinate edges.

4. The louver fabricating tool of claim 1, wherein said recessed area is bound by said side walls, said projection, and intermediate side wall and said apex wall.

5. The louver fabricating tool of claim 1, wherein said recessed area includes intermediate side walls adjacent said projection.

6. The louver fabricating tool of claim 5, wherein said intermediate side walls include circinate edges.

7. The louver fabricating tool of claim 1, including fastening means for fastening said shaper element and said die element together.

8. The louver fabricating tool of claim 7, wherein said fastening means comprises stud bolts and nuts.

9. The louver fabricating tool of claim 8, wherein said stud bolts are integrally fastened to said shaper element.

10. The louver fabricating tool of claim 9, wherein said stud bolts are fastened to the shaper element in the abutting region.

11. The louver fabricating tool of claim 8, wherein said recessed area includes openings sized to accommodate said stud bolts.

12. The louver fabricating tool of claim 1, wherein said shaper element includes a tuck flap of a length less than the length of the shaper segment.

13. The louver fabricating tool of claim 1, wherein said shaper segment is shorter in length than the length of the abutting region.

14. The louver fabricating tool of claim 1, wherein said abutting region and said shaper segment are integrally formed.

15. A portable louver tool capable of forming louvers in a material wherein an operator only has access to one side of said material comprising:

(1) a die element; and (2) a shaping element wherein said die element includes a recessed portion having at least two circinate edges, and said shaping element includes a region capable of being received by said recessed portion during fabrication of said louver, said shaping element includes a shaper segment having recessed ledges at each end thereof said shaper element further including a tuck flap attached to said shaper segment for insertion into an incision in the work material.

* * * * *